US007516727B2

(12) United States Patent
Ueshima et al.

(10) Patent No.: US 7,516,727 B2
(45) Date of Patent: Apr. 14, 2009

(54) VEHICLE COMBUSTION ENGINE

(75) Inventors: Atsushi Ueshima, Akashi (JP); Takahiro Ono, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 42 days.

(21) Appl. No.: 11/857,928

(22) Filed: Sep. 19, 2007

(65) Prior Publication Data

US 2008/0072867 A1 Mar. 27, 2008

(30) Foreign Application Priority Data

Sep. 21, 2006 (JP) ..... 2006-256346
Sep. 21, 2006 (JP) ..... 2006-256347

(51) Int. Cl.
*F02B 75/22* (2006.01)
*F01M 1/02* (2006.01)

(52) U.S. Cl. ..... 123/195 R; 123/41.33; 123/196 R; 123/196 A; 123/196 AB

(58) Field of Classification Search ..... 123/41.33, 123/195 R, 195 AC, 196 R, 196 A, 196 AB
See application file for complete search history.

(56) References Cited

U.S. PATENT DOCUMENTS

2005/0023200 A1 2/2005 Ueshima et al.
2005/0193965 A1 * 9/2005 Nakatsuka et al. ..... 123/196 R

FOREIGN PATENT DOCUMENTS

JP 2005-48725 2/2005

* cited by examiner

*Primary Examiner*—Noah Kamen

(57) ABSTRACT

A vehicle combustion engine includes an engine cylinder block having an exhaust port defined in a front surface area thereof and fluidly connected with an exhaust tube. A transmission is arranged rearwardly of a crankcase. The vehicle combustion engine also includes at least one of an oil filter for filtering oil and an oil cooler for cooling the oil, which is positioned outside the cylinder block and the crankcase, but close to a lower portion of the cylinder block at a location rearwardly of the cylinder block.

7 Claims, 4 Drawing Sheets

VEHICLE COMBUSTION ENGINE

BACKGROUND OF THE INVENTION

1. Field of the Invention

The present invention relates to a combustion engine for use mainly in an automotive vehicle such as, for example, a motorcycle and, more particularly, to an arrangement of an oil cooler and an oil filter disposed on an oil supply passage for the supply of an engine lubricating oil to the combustion engine and also to a lubricating device for supplying a lubricating oil to the combustion engine and a transmission.

2. Description of the Prior Art

In the four cycle combustion engine used in motorcycles now in use, the oil filter and the oil cooler are generally mounted on a crankcase, having been spaced a distance from each other and, therefore, a piping system including engine oil passages within the crankcase tends to become so complicated as to result in reduction in productivity and increase of the cost. The Japanese Laid-open Patent Publication No. 2005-48725, published Feb. 24, 2005, discloses a unitary structure of the oil filter and the oil cooler, which is installed in a lower portion of a front surface of the crankcase.

Considering that in the motorcycle combustion engine, a cylinder block of the combustion engine is generally mounted atop the crankcase and a motorcycle transmission is arranged at a rear portion thereof, the motorcycle combustion engine has a center of gravity located in the vicinity of a root portion of a rear surface of the cylinder block. However, since in the previously mentioned patent document, the unitary structure of the oil filter and the oil cooler, that is, a combination filter and cooler unit is arranged at a lower portion of the front surface of the crankcase, the mass of the combustion engine is dispersed and, therefore, the mass distribution of the combustion engine tends to be unfavorable from the point of a weight balance. Also, the positioning of the combination filter and cooler unit at the lower portion of the front surface of the crankcase tends to impose limitation in the layout of the motorcycle exhaust pipe.

SUMMARY OF THE INVENTION

In view of the foregoing, the present invention has been devised to substantially eliminate the problems and inconveniences inherent in the prior art vehicle combustion engine system and is intended to provide a vehicle combustion engine with neatly distributed mass and the freedom of layout in positioning the exhaust pipe.

In order to accomplish the foregoing object of the present invention, there is provided a vehicle combustion engine including a crankcase and an engine cylinder block mounted on the crankcase. An exhaust tube is fluidly connected with an exhaust port defined in a front surface of the combustion engine and a vehicle transmission is arranged at a rear portion of the crankcase. The vehicle combustion engine also includes at least one of an oil filter for filtering oil and an oil cooler for cooling the oil, which is positioned outside the cylinder block and the crankcase, but close to a lower portion of the cylinder block at a location rearwardly of the cylinder block.

According to the present invention, at least one of the oil filter and the oil cooler is arranged close to the lower portion of the cylinder block at the location rearwardly of the cylinder block, where the center of gravity of the vehicle combustion engine is located. Accordingly, the mass of the combustion engine can be concentrated in the vicinity of the center of gravity of the combustion engine resulting in favorable weight balance of the engine and, hence, the combustion engine can be placed in a well balanced condition with respect to the automotive vehicle as a whole. Since a free space is available in a front surface area of the combustion engine, where the combination filter and cooler unit has hitherto been installed, a relatively large freedom of design in positioning the exhaust pipe, fluidly coupled with the exhaust port in the front area of the combustion engine, can be advantageously appreciated.

In a preferred embodiment of the present invention, at least the oil cooler is preferably arranged close to the lower portion of the cylinder block at the location rearwardly of the cylinder block so that a cooler cooling water delivery passage for discharging a cooling water from the oil cooler can be fluidly connected with a cooling water return passage that extends from a radiator to a water pump. According to this preferred embodiment, the cooling water is guided from the oil cooler, disposed at a root portion of the cylinder block, to the cooler cooling water delivery passage. Then, the cooling water, after having been introduced into the cooling water return passage, is returned directly to the water pump without passing through either the combustion engine nor the radiator, flowing a short recirculating passage leading to the oil cooler. Accordingly, the flow resistance of the cooling water advantageously decreases to increase the cooling capacity of the oil cooler, thereby lowering the temperature of the engine oil within the oil cooler effectively. Also, considering that the water pump is generally arranged laterally of the transmission, the distance from the water pump to the oil cooler decreases as compared with that in the conventional engine where the oil cooler is arranged forwardly of the engine, and, hence, the length of pipe extending from the water pump to the oil cooler can decrease correspondingly. Also, since the pipe extending from the water pump to the oil cooler and the pipe used to define the cooling water return passage are positioned on a back side (rearwardly) of the cylinder block and do not exist in front of the combustion engine, the both pipe will not interfere with the exhaust pipe and the cooling water passage terminates at a rear surface of the cylinder block and, therefore, the maintenance will not be disturbed by the presence of the exhaust pipe and can therefore be facilitated.

In another preferred embodiment of the present invention, the vehicle combustion engine preferably includes a combination filter and cooler unit comprising the oil filter and the oil cooler, which are combined together. The use of the combination filter and cooler unit is advantageous in that since the oil filter and the oil cooler are both arranged at a root portion of the cylinder block, which lies in the vicinity of the center of gravity of the combustion engine, the mass of the combustion engine can be centered further in the vicinity of the center of the gravity of the combustion engine to allow the weight of the combustion engine to be further well balanced. Also, since in the combination filter and cooler unit, the oil filter and the oil cooler are combined together, compactness can be appreciated.

In a still further preferred embodiment of the present invention, the vehicle combustion engine may furthermore include an oil pump driven by the combustion engine to supply the oil to the combination filter and cooler unit. In this case, the combination filter and cooler unit is positioned immediately above the oil pump. In this arrangement, an oil supply passage fluidly connecting between the combination filter and cooler unit and the oil pump can be advantageously shortened.

In a further preferred embodiment of the present invention, the vehicle combustion engine may also include an oil pump driven by the combustion engine for supplying the oil to both of the oil filter and the oil cooler and a branched supply passage for supplying the oil from the oil cooler in part to the transmission and in part to the combustion engine.

According to this preferred feature, since the oil discharged from the oil cooler into the branched supply passage is supplied in part to the transmission and in part to the combustion engine, the pressure of the oil supplied to the combustion engine can be lowered, accompanied by a corresponding reduction in flow resistance, and, accordingly, an effect similar to that in which a pressure loss is reduced can be obtained. As a result thereof, the discharge pressure of the oil pump decreases, accompanied by increase of the flow rate, and, therefore, the pump efficiency can be increased. Due to this effect, even though the oil pump of a relatively small capacity is employed in the practice of the present invention, a required oil lubricating performance can be obtained.

In a still further preferred embodiment of the present invention, the branched supply passage may include a main delivery passageway for delivering the oil from the oil cooler, first and second branched passageways extending from the main delivery passageway to the transmission, and a third branched passageway for delivering the oil to the combustion engine. The third branched passageway is fluidly connected with a portion of the main delivery passageway between a junction, at which the main delivery passageway is fluid connected with the first branched passageway, and a junction, at which the main delivery passageway is fluid connected with the second branched passageway. According to this passage system, since the oil delivered from the oil cooler into the main delivery passageway can be supplied to the combustion engine through the third branched passageway, in parallel to the supply of the oil to the transmission through the first and second branched passageways and, accordingly, the pressure under which the oil is supplied toward the combustion engine can be reduced to a proper level so that an oil pump of a relatively small capacity can be employed. As a result, the vehicle combustion engine of the present invention can be assembled compact in size.

In a still further preferred embodiment of the present invention, the vehicle combustion engine may further include a main gallery provided in the crankcase of the combustion engine and fluidly connected with the third branched passageway, and a fourth branched passageway extending from the main gallery to a cylinder head.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, a preferred embodiment of the present invention will be described in detail with reference to the accompanying drawings.

Figure 1:
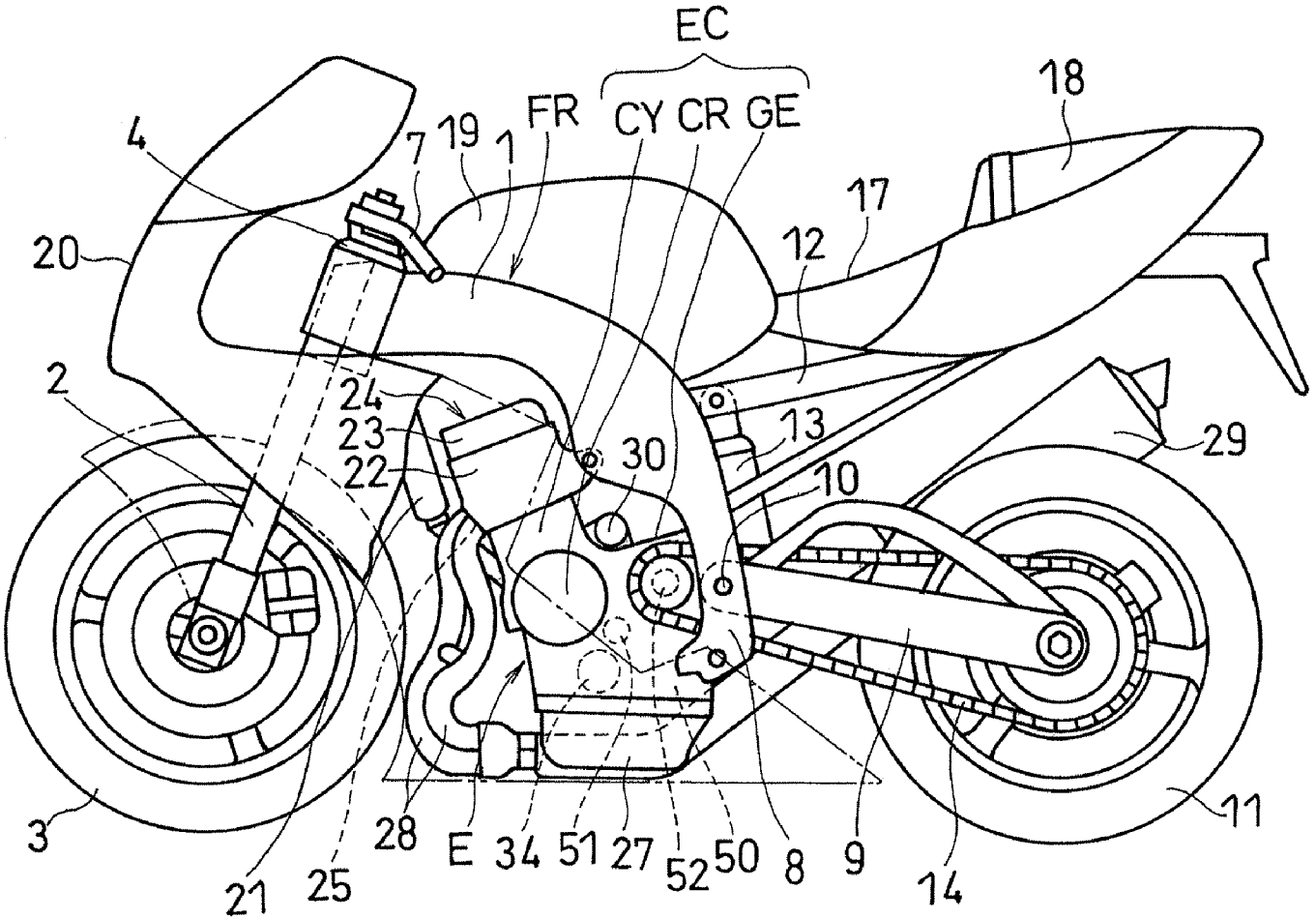
FIG. 1 is a side view of a motorcycle equipped with a vehicle combustion engine having a lubricating device in accordance with a preferred embodiment of the present invention.

FIG. 1 illustrates, in a side view, a motorcycle having an engine lubricating device mounted thereon in accordance with a preferred embodiment of the present invention. The motorcycle shown therein includes a motorcycle frame structure FR made up of a main frame 1, forming a front half of the motorcycle frame structure FR, and a seat rail assembly 12 forming a rear half of the motorcycle frame structure FR. A front fork 2, with a front wheel 3 being rotatably supported by a lower end portion thereof, is supported by a front portion of the main frame 1. An upper bracket 4 supports an upper end portion of the front fork 2. A steering handlebar 7 is mounted on the upper bracket 4. The main frame 1 is provided at a lower rear end portion with a swingarm bracket 8, with which a swingarm 9 is connected through a pivot pin 10 for pivotable movement up and down about the pivot pin 10. This swingarm 9 carries a rear drive wheel 11 rotatably supported by a rear end thereof. The seat rail assembly 12 is rigidly connected with a rear portion of the main frame 1, and a rear suspension 13 is interposed between the main frame 1 and the swingarm 9.

A motorcycle combustion engine E is mounted on a generally intermediate lower portion of the main frame 1 in a fashion tilted forwards and a radiator 21 is disposed forwards of the combustion engine E. The illustrated motorcycle is so designed that the rear drive wheel 11 can be driven by the combustion engine E by means of a substantially endless drive chain 14 and the front wheel 3 can be maneuvered through the handlebar 7. The seat rail assembly 12 in the rear frame portion of the motorcycle frame structure FR has a rider's seat 17 and a fellow passenger's seat 18 mounted thereon. A fuel tank 19 accommodating a quantity of fuel is mounted on the main frame 1 between the handlebar 7 and the rider's seat 17. Also, a fairing 20 made of a synthetic resin is fixedly mounted on a front portion of the motorcycle so as to cover a front to side region of the motorcycle frame structure FR, including a front area forwardly of the handlebar 7 and side areas generally laterally of and below the combustion engine E.

The combustion engine E so far shown is a four cylinder, four stroke combustion engine and has an engine casing EC including a crankcase CR, a cylinder block CY positioned atop the crankcase CR, and a gear casing GE positioned rearwardly of the crankcase CR. The combustion engine E also has a transmission accommodated within the gear casing GE as will be detailed later. A cylinder head 22 having a valve chamber defined therein is mounted atop the cylinder block CY and a cylinder head cover 23 is in turn mounted atop the cylinder head 22 so as to cover the valve chamber in the cylinder head 22.

As is well known to those skilled in the art, the engine casing EC, the cylinder head 22 and the cylinder head cover 23 altogether constitute an engine body 24.

The cylinder head 22 has a front surface area having a plurality of exhaust ports 25 defined therein and fluidly connected with exhaust tubes 28. The exhaust tubes 28 extends below the combustion engine E and are then communicated with a muffler 29 positioned at a rear portion of the motorcycle. An oil pan 27 accommodating a quantity of oil is provided below the crankcase CR.

Figure 2:
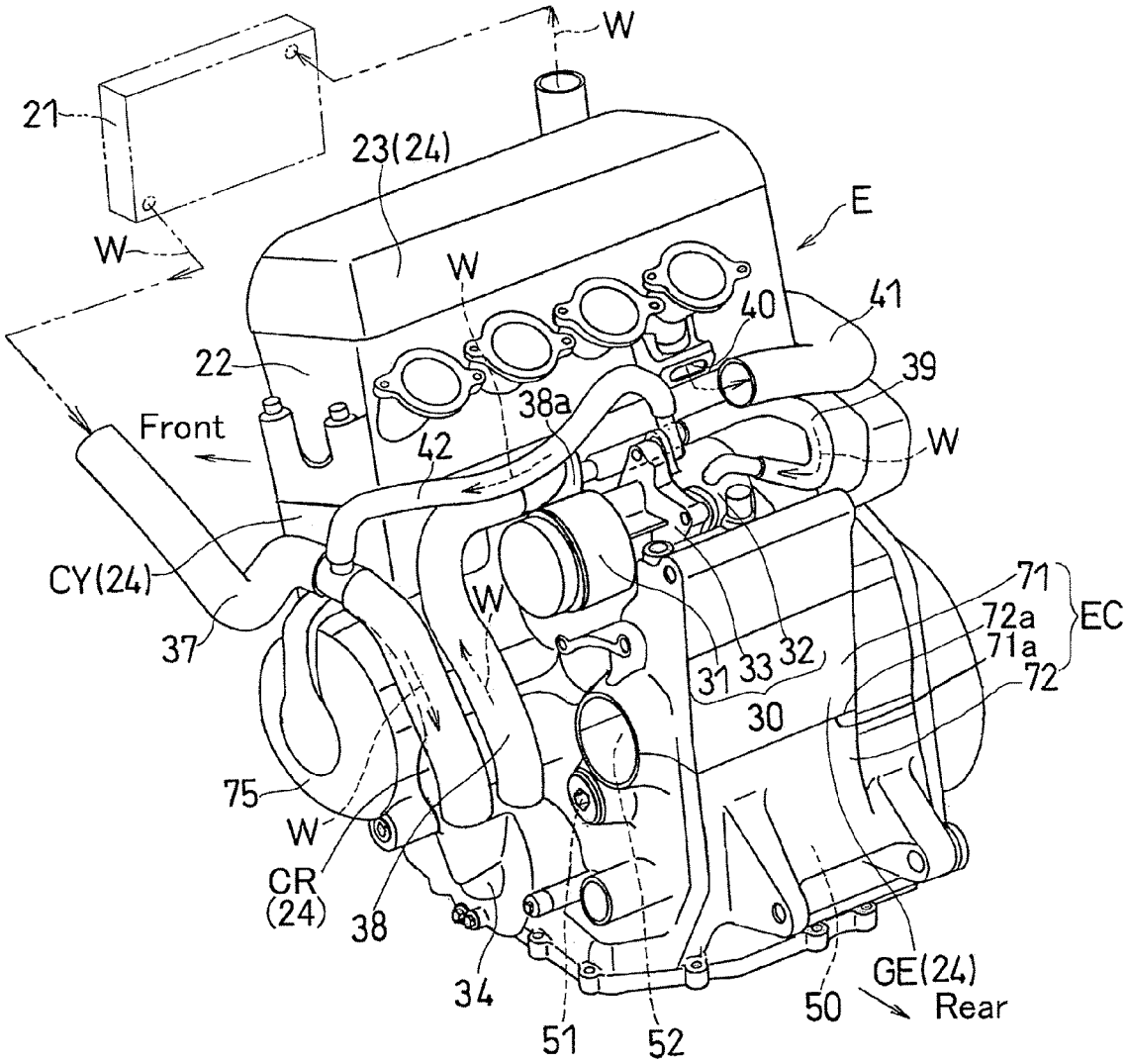
FIG. 2 is a perspective view of the vehicle combustion engine as viewed from rear thereof.

Referring to FIG. 2, showing in a perspective representation the combustion engine E as viewed from rear of the motorcycle, the engine casing EC is of a structure including an upper casing 71 and a lower casing 72 connected together with their mating surfaces 71*a*, 71*b* held in tight contact with each other, and a lateral portion of the crankcase CR, defined by front halves of those casings 71 and 72 is covered by a crankcase covering 75.

A combination filter and cooler unit 30, as will be described in detail later, is positioned outside the cylinder block CY and the crankcase CR and arranged at a location rearwardly of the cylinder block CY, but close to a bottom area of the cylinder block CY. This combination filter and cooler unit 30 is made up of an oil filter 31 operable to filter a lubricant oil supplied from an oil pump and an oil cooler 32 operable to cool such lubricant oil. The oil filter 31 and the oil cooler 32 are integrated together through a coupling bracket 33 interposed therebetween to define the combination filter and cooler unit 30.

Generally in the motorcycle combustion engine E, as shown in FIG. 1, the cylinder block CY is fixedly mounted on an upper portion of the crankcase CR and the gear casing GE is fitted to a rear portion of the crankcase CR, with the center of gravity of the combustion engine E positioned rearwardly of the cylinder block CY and in the vicinity of a bottom area of the cylinder block CY.

However, in the present invention, the combination filter and cooler unit 30 is arranged at a location rearwardly of and in the vicinity of the bottom area of the cylinder block CY, where the center of gravity of the combustion engine E lies. Therefore, the mass of the combustion engine E is so centered in the vicinity of the center of gravity thereof as to render the weight of the combustion engine E kept in a well balanced condition and, hence, to allow the weight of the motorcycle to be balanced. This effect can be appreciated even when either one of the oil filter 31 and the oil cooler 32 is arranged at a location rearwardly of and in the vicinity of the bottom area of the cylinder block CY.

Also, in the combustion engine E shown in FIG. 1, a vacant space is available at a location adjacent a front surface area of the combustion engine E, which has hitherto been occupied by the oil filter and the oil cooler both employed in the conventional engine, and, therefore, a freedom of layout of the exhaust tubes 28 extending past the front surface area of the combustion engine E can be increased.

A cooling recirculating circuit in a cooling system for the combustion engine E will now be described. A cooling water W, from which heat has been liberated in the radiator 21 shown in FIG. 1, flows through a cooling water return passage 37, shown in FIG. 2, towards a water pump 34 provided at a lower side portion of the gear casing GE. The cooling water W is then pumped by the water pump 34 to flow through a cooling water supply passage 38 towards the engine body 24 and then to flow through a cooling water circulating passage (not shown), defined inside the cylinder block CY and the cylinder head 22 of the engine body 24, towards the oil cooler 32 by way of a branched passage 39 ramified from a downstream end 38*a* of the cooling water supply passage 38. The cooling water W, which has circulated inside, and has been used to cool the cylinder block CY and the cylinder head 22, is returned from a cooling water discharge port 40, defined in the cylinder head 22, to the radiator 21 positioned forwardly of the combustion engine E, after having passed through an engine cooling water delivery passage 41.

On the other hand, the cooling water W used to cool the oil inside the oil cooler 32 flows through a cooler cooling water delivery passage 42 and then merges with the cooling water W within the cooling water return passage 37. In other words, the oil within the oil cooler 32 is cooled by the cooling water W which circulates in a short time within a short recirculating channel extending from the water pump 34 back to the water pump 34 through the cooling water supply passage 38, then through the branched passage 39, further through the oil cooler 32, yet further through the cooler cooling water delivery passage 42 and finally through the cooling water return passage 37. Because of this, the cooling water W flowing through this short recirculating channel permits the oil cooler 32 to exhibit an increased cooling performance since thanks to reduction in flow resistance the cooling water W can flow at an increased velocity. Thus, it has been found that the temperature of the oil within the oil cooler 32 could be reduced by about 5° C. than that hitherto experienced with the conventional combustion engine.

Also, since the water pump 34 is generally arranged laterally of the transmission 50, the distance from the water pump 34 to the oil cooler 32 can be reduced to a value smaller than that in the conventional case, in which the oil cooler is arranged forwardly of the combustion engine, and, correspondingly, the pipe line used to define the cooling water passage extending from the water pump 34 to the oil cooler 32 can have a reduced length. Yet, since the pipe line from the water pump 34 to the oil cooler 32 and the pipe line used to define the cooling water return passage 37 are positioned at a backside (rearwardly) of the cylinder block CY and do not exist forwardly of the combustion engine E, they will not interfere with the exhaust tubes 28 and the cooling water piping in the oil cooler 32 can terminate at a backside of the cylinder block CY and, therefore, maintenance and servicing inspection thereof will not be disturbed by the presence of the exhaust tubes 28 and can be accomplished easily.

Figure 3:
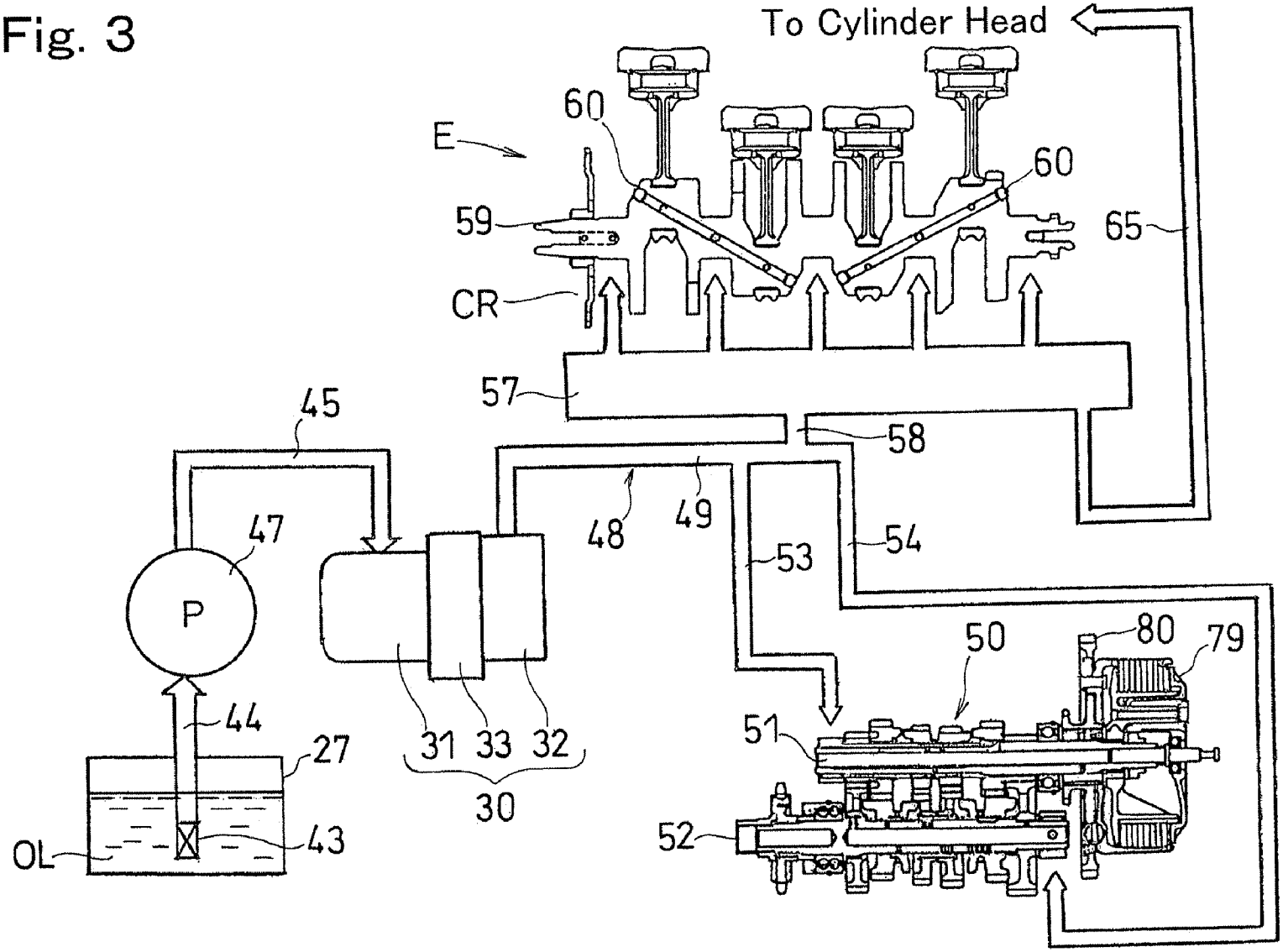
FIG. 3 is a diagram of a piping system employed in the vehicle combustion engine, showing the details of an oil recirculating system used therein.

The recirculating path for the lubricant oil will now be described with particular reference to FIGS. 3 and 4. Referring to FIG. 3, which is a piping system diagram showing a whole of oil recirculating path, a quantity of oil OL pooling within the oil pan 27 disposed beneath the combustion engine E is pumped up by an oil pump 47 driven by a crankshaft 59 of the combustion engine E. The oil OL so pumped up flows into a suction tube 44 through a primary filter 43 provided at a lower end thereof, and then into an oil supply passage 45 and further into the combination filter and cooler unit 30.

Figure 4:
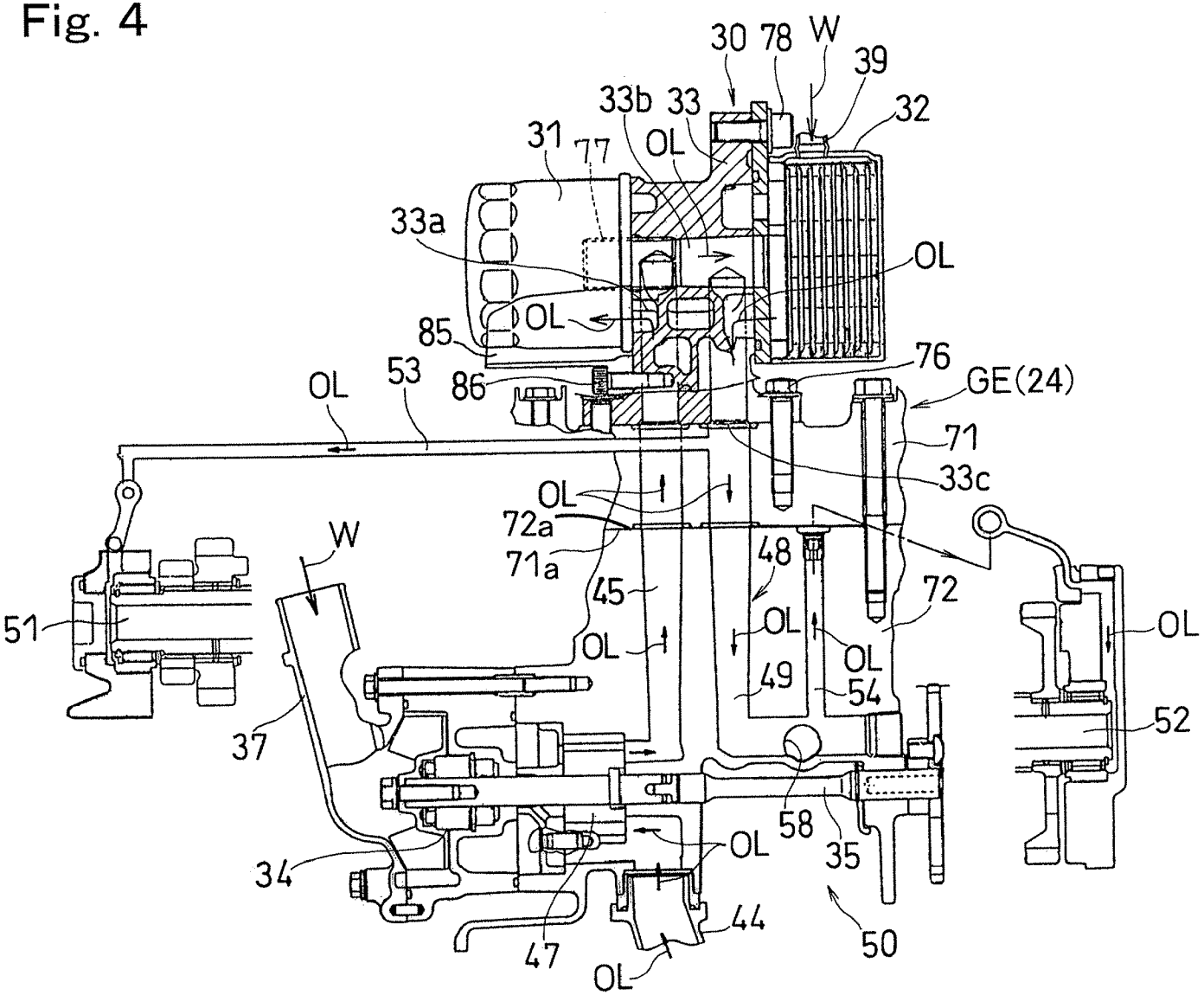
FIG. 4 is a sectional view showing the details of an essential portion of the oil recirculating system shown in FIG. 3.

Referring particularly to FIG. 4, which is a piping system diagram showing the details of an essential portion of the oil recirculating path, the coupling bracket 33 for the combination filter and cooler unit 30 is fitted to an upper surface of the gear casing GE, which is formed by rear portions of the respective upper and lower casing 71 and 72, by means of mounting bolts 76. The oil filter 31 is secured to one of opposite support surfaces of the coupling bracket 33 by means of a hollow stud bolt 77 that lies in alignment with a horizontal center axis and, on the other hand, the oil cooler 32 is fixedly coupled with the other of the support surfaces of the coupling bracket 33 by means of one or more connecting bolts 78. Thus, the oil filter 31 and the oil cooler 32, both coupled with the coupling bracket 33 in the manner described above, are integrated together through the coupling bracket 33 as a unitary structure to thereby define the combination filter and cooler unit 30.

The coupling bracket 33 has a filter cover 85 fitted thereto by means of cover mounting bolts 86 and positioned below the oil filter 31. This filter cover 85 is effective to avoid an undesirable fall of drops of the oil OL onto the engine body 24, which would otherwise occur when the oil filter 31 is removed for maintenance from the coupling bracket 33 in the absence of the filter cover.

The oil OL pumped up by the oil pump 47 is supplied through an oil supply passage 33*a*, defined in the coupling bracket 33 of the combination filter and cooler unit 30, to the oil filter 31 at which foreign matter such as, for example, metallic particles and/or dust is removed from the oil OL. The oil OL, substantially purified by the oil filter 31, subsequently flow into the oil cooler 32 through an oil communicating passage 33*b*, defined in part in the hollow stud bolt 77 and in part in the coupling bracket 33. The oil OL is, after having been cooled by the cooling water W introduced into the oil cooler 32 through the branched passage 39, delivered from an oil delivery port 33*c*, defined in the coupling bracket 33, into a main delivery passageway 49 of a branched supply passage 48. The oil pump 47 is provided on the same pump shaft 35 of the water pump 34, which is drivingly coupled with the crankshaft 59 (FIG. 3), so that the oil pump 47 and the water pump 34 can be driven by the crankshaft 59 in unison with each other.

Referring again to FIG. 3, the oil OL flowing into the main delivery passageway 49 of the branched supply passage 48 is supplied in part to the transmission 50 and in part to the combustion engine E. In other words, the branched supply passage 48 for the oil OL includes, in addition to the main delivery passageway 49 for delivering the oil OL from the oil cooler 32, first and second branched passageways 53 and 54 that are branched off from the main delivery passageway 49 so as to extend respectively towards input and output shafts 51 and 52 of the transmission 50.

It is to be noted that the transmission 50 so far shown in connection with the preferred embodiment of the present invention is of a type, in which a clutch gear 80 on the input shaft 51 is meshed with a crank gear (not shown) so that the drive force can be transmitted to the input shaft 51 through a clutch 79. Also, the drive force transmitted to the input shaft 51 is in turn transmitted from the output shaft 52 to the motorcycle drive chain 14, shown in FIG. 1, through a gear-shift mechanism intervening between the input shaft 51 and the output shaft 52, to thereby drive the rear drive wheel 11.

The branched supply passage 48 shown in FIG. 3 also includes a third branched passageway 58 that is fluidly connected with a portion of the main delivery passageway 49 between a junction, at which the main delivery passageway 49 is fluidly connected with the first branched passageway 53, and a junction, at which the main delivery passageway 49 is fluidly connected with the second branched passageway 54. This third branched passageway 58 extends from that portion of the main delivery passageway 49 towards a main gallery 57 provided within the crankcase CR of the combustion engine E.

The oil OL flowing into the main gallery 57 is supplied to various portions of the combustion engine E, including, for example, the crankshaft 59 and a big end 60 of a connecting rod, to lubricate them and, at the same time, to the cylinder head 22 through a fourth branched passageway 65 to lubricate a camshaft (not shown).

It is to be noted that although not shown, the oil OL may be supplied through a passageway, branched off from the first branched passageway 53, to an oil pressure tensioner or an oil control valve for driving a variable valve timing mechanism in the camshaft.

As shown in FIG. 4, the oil supply passage 45 and the main delivery passageway 49 are each defined in part in the upper casing 71 and in part in the lower casing 72 so as to extend substantially vertically. Since, as can readily be understood from FIG. 1, the combination filter and cooler unit 30 is positioned substantially above the water pump 34, that is, immediately above the oil pump 47 having the same pump shaft 45 as the water pump 34 and in the vicinity of the transmission 50, the oil supply passage 45 and the main delivery passageway 49, both shown in FIG. 4, can be a substantially straight short channel. Accordingly, as compared with the conventional case, in which the combination filter and cooler unit is arranged forwardly of the combustion engine, the branched supply passage 48 can have a reduced length.

Also, in the oil recirculating path for the oil OL described hereinabove, the oil OL, cooled as it flows through the oil cooler 32 in FIG. 3, is supplied not only to the main gallery 57, but also to the input and output shafts 51 and 52 of the transmission 50 through the first and second branched passageways 53 and 54 by way of the main delivery passageway 49 of the branched supply passage 48, respectively. In the conventional case such as disclosed in, for example, the previously mentioned Japanese Laid-open Patent Publication No. 2005-48725, the combination filter and cooler unit is arranged at a front portion of the combustion engine and, hence positioned a substantial distance from the transmission and, accordingly, the oil is supplied to the transmission through the main gallery. However, in the embodiment of the present invention particularly shown in and described with reference to FIG. 3, since the combination filter and cooler unit 30 is positioned close to the transmission 50, the first and second branched passageways 53 and 54 can be provided easily and, therefore, the pressure of the oil OL within the main gallery 57 can be lowered, accompanied by reduction of the oil flow resistance in the combustion engine as a whole. Accordingly, an effect similar to that, in which the pressure loss within the combustion engine E is reduced, can be obtained and, hence, the discharge pressure of the oil pump 47 can be lowered. Since the discharge flow rate increases with decrease of the discharge pressure of the oil pump 47, the pump efficiency can increase. In other words, even though the oil pump 47 of a relatively small capacity is employed, the required oil recirculating performance, that is, the required flow rate of the oil OL can be obtained and, therefore, the combustion engine E can be manufactured compact in size. It is to be noted that at a stage preceding the main gallery 57 of the combustion engine E, the oil OL is delivered only through the first branched passageway 53, not through both of the first and second branched passageways 53 and 54, and, therefore, the pressure of the oil within the main gallery 57 will not be lowered excessively and can be maintained at a proper level.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, the present invention can be equally applied to a vehicle combustion engine having a different number of cylinders than that shown and described hereinbefore. In particular, the present invention can be equally applied to any other vehicle than the motorcycle, such as, for example, a three-wheeled vehicle or a four-wheeled off-road vehicle.

Accordingly, such changes and modifications are, unless they depart from the scope of the present invention as delivered from the claims annexed hereto, to be construed as included therein.

What is claimed is:

1. A vehicle combustion engine which comprises:

a crankcase;

an engine cylinder block mounted on the crankcase;

an exhaust tube fluidly connected with an exhaust port defined in a front surface of the combustion engine;

a vehicle transmission arranged at a rear portion of the crankcase; and at least one of an oil filter for filtering oil and an oil cooler for cooling the oil, which is positioned outside the cylinder block and the crankcase, but close to a lower portion of the cylinder block and above said transmission at a location rearwardly of the cylinder block.

2. The vehicle combustion engine as claimed in claim 1, wherein at least the oil cooler is arranged close to the lower portion of the cylinder block at the location rearwardly of the cylinder block and further comprising:

a radiator;

a water pump driven by the combustion engine;

a cooler cooling water delivery passage for discharging a cooling water from the oil cooler; and a cooling water return passage that extends from the radiator to the water pump, the cooler cooling water delivery passage being fluidly connected with the cooling water return passage.

3. The vehicle combustion engine as claimed in claim 1, wherein the oil filter and the oil cooler are combined together to define a combination filter and cooler unit.

4. The vehicle combustion engine as claimed in claim 3, further comprising an oil pump driven by the combustion engine to supply the oil to the combination filter and cooler unit and wherein the combination filter and cooler unit is positioned immediately above the oil pump.

5. The vehicle combustion engine as claimed in claim 1, further comprising an oil pump driven by the combustion engine to supply the oil to both of the oil filter and the oil cooler, and a branched supply passage for supplying the oil from the oil cooler in part to the transmission and in part to the combustion engine.

6. The vehicle combustion engine as claimed in claim 5, wherein the branched supply passage comprises a main delivery passageway for delivering the oil from the oil cooler, first and second branched passageways extending from the main delivery passageway to the transmission, and a third branched passage fluidly connected with a portion of the main delivery passageway between a junction, at which the main delivery passageway is fluidly connected with the first branched passageway, and a junction, at which the main delivery passageway is fluidly connected with the second branched passageway, and extending from that portion of the main delivery passage towards the combustion engine.

7. The vehicle combustion engine as claimed in claim 6, further comprising a main gallery provided in the crankcase of the combustion engine and fluidly connected with the third branched passageway, and a fourth branched passageway extending from the main gallery to a cylinder head.

* * * * *